United States Patent [19]

Hastings

[11] 4,317,606

[45] Mar. 2, 1982

[54] COMPLETE STUDIO

[76] Inventor: Jeanne D. Hastings, Old Stone Schoolhouse, Middle Rd., Lake George, N.Y. 12845

[21] Appl. No.: 147,163

[22] Filed: May 6, 1980

[51] Int. Cl.[3] ..... A47B 27/00

[52] U.S. Cl. ..... 312/231; 312/123; 312/298; 312/324

[58] Field of Search ..... 312/231, 233, 258, 123, 312/120, 129, 302, 298, 324

[56] References Cited

U.S. PATENT DOCUMENTS

| | | | |
|---|---|---|---|
| 654,922 | 7/1900 | Schipkowsky | 312/298 |
| 657,930 | 9/1900 | Feldkircher | 312/123 |
| 775,594 | 11/1904 | Bigelow et al. | 312/123 |
| 1,943,282 | 1/1934 | Bellavia | 312/233 |
| 2,104,939 | 1/1938 | Whalen | 312/302 |
| 2,190,498 | 2/1940 | Williams | 312/244 |
| 3,202,471 | 8/1965 | Wilson | 312/231 |
| 3,476,456 | 11/1969 | Canavan | 312/231 |
| 3,630,588 | 12/1971 | Baker | 312/231 |
| 4,076,348 | 2/1978 | Allison | 312/231 |
| 4,149,763 | 4/1979 | Delahaie | 312/231 |

FOREIGN PATENT DOCUMENTS

| | | | |
|---|---|---|---|
| 631153 | 10/1949 | United Kingdom | 312/244 |

*Primary Examiner*—Victor N. Sakran
*Attorney, Agent, or Firm*—Low & Low

[57] ABSTRACT

A mobile cabinet with two drop leafs which in its nested position is a beautiful article of furniture and in its operating position provides an easel and work area. One end of said cabinet opens from a nested position to a functioning position in which it supports the drop leafs and two sections provide compartments for tubes of paint, brushes, painting knives, mediums, turpentine, and other artist materials.

4 Claims, 4 Drawing Figures

COMPLETE STUDIO

BACKGROUND OF THE INVENTION

This invention relates to artist equipment and particularly to an improved artist studio. We are all generally familiar with the fact that an artist in his work uses an easel; that he works with paints that come in tubes; that he needs brushes, turpentine, thinners and other materials to be able to apply the paints to a canvas. The easel, as we know it, supports the canvas.

Anyone who is familiar with the workings of an artist recognizes the "mess" that is usually in his general environs; with brushes, paint, pallette and easel spread around the room.

Customarily, painters use an easel and a separate taboret or table which occupies a great deal of space ordinarily no longer found in the average home. Contemporary living quarters are of necessity small, confined and compact and rarely offer an area for the clutter of creative work.

It is, therefore, a first object of this invention to provide an artist with a convertible article of furniture which permits the artist to have a studio and to use all his equipment while he is working and which permits him to store all his equipment when he is not.

It is the still further object of this invention to provide an improved article of furniture which blends into the decor of a room and which can be converted into a complete artist's studio.

It is a further object of this invention to make it possible for an artist to work in a small organized space with minimum disruption of the normal everyday living routine.

It is the still further object of this invention to provide an improved convertible article of furniture which in a nested position is a uni-leg drop leaf table and which in its functioning position is a complete artist's studio.

Basically, I have invented a means to improve working conditions for the artist by combining an easel, a taboret and a drop leaf cabinet in one piece of furniture.

DESCRIPTION OF THE DRAWINGS

These and other objects and advantages of this invention will become apparent to those skilled in the art, and can be better understood from the following specifications and drawings, wherein.

DETAILED DESCRIPTION OF THE INVENTION

Figure 1:
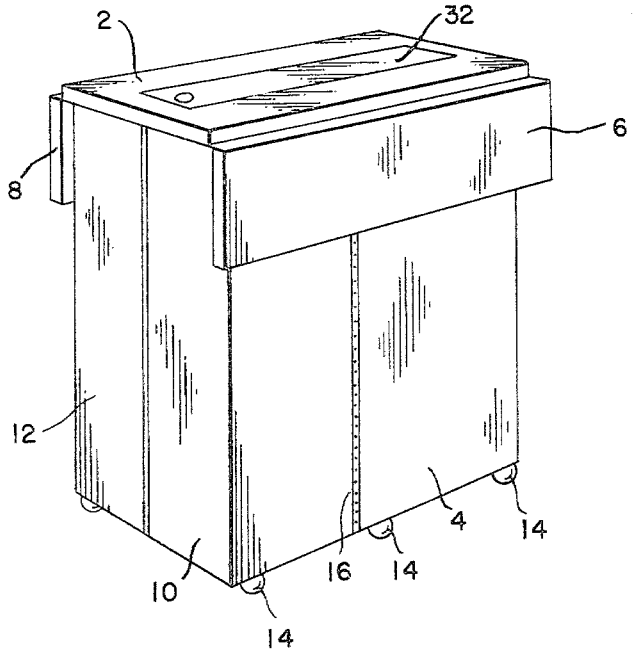
FIG. 1 is a perspective view of a convertible drop leaf table in its nested position.

Referring now to the drawings, a convertible studio is shown comprising a top, 2; a base, 4; a pair of drop leafs, 6,8; a pair of main components, 10,12; and a plurality of ball casters, 14, which support the base and the main components. In addition, there are sub components which will be described.

Figure 2:
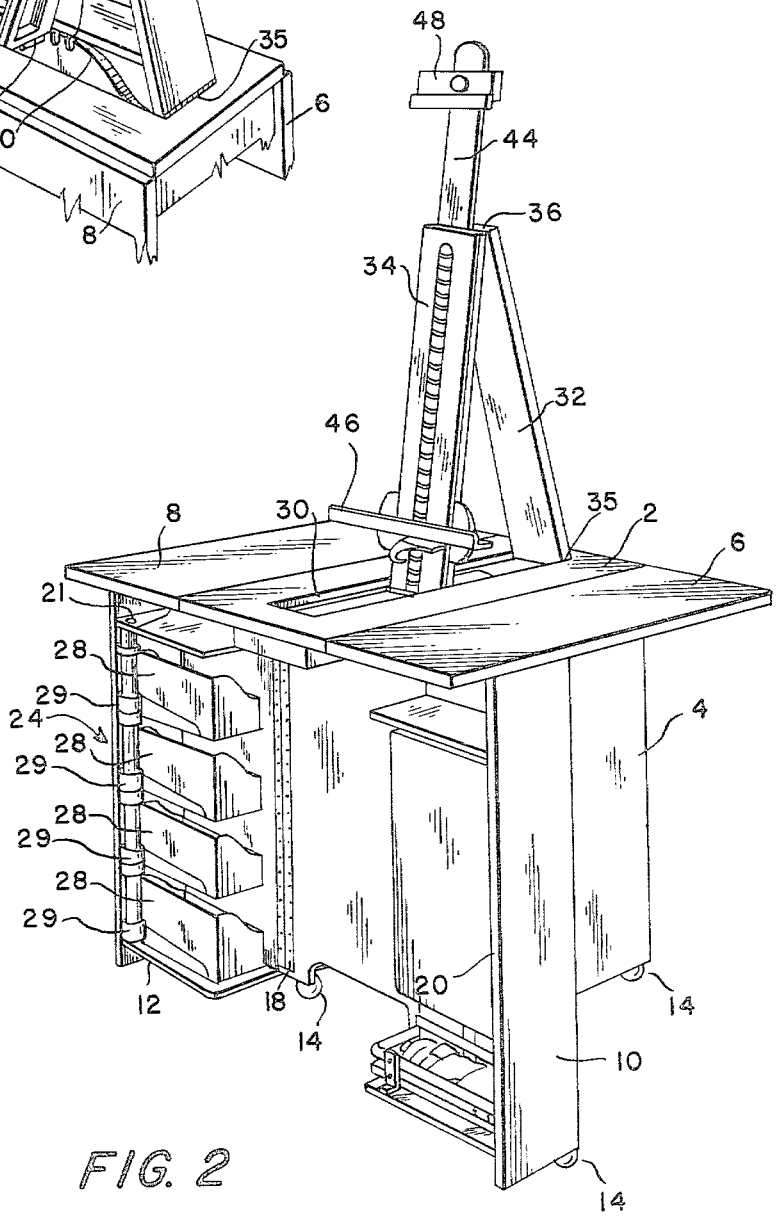
FIG. 2 is a perspective view of the drop leaf after it has been converted into an artist's studio with the main components being articulated from their nested position to their functioning position.

The drop leafs 6,8 are supported by hinges which are conventional piano-type hinges that interconnect each drop leaf to the base to permit the articulation of a drop leaf from its nested position as shown in FIG. 1 to its active position as shown in FIG. 2.

While these hinges are not shown in the drawing as supporting drop leafs 6,8 they are of the same type as vertical hinge 16 which supports the main component 10 from the base 4. The hinge 16 is a piano-type hinge that permits the main component 10 to be nested and lie co-planar with one side of the base, as shown in FIG. 1. The identical support hinge 18 is provided for the opposite main component 12 so that when the main components are nested, they form a uni-leg in conjunction with base 4 for the top 2 which is secured to the base 4. The components 10, 12 define L-shaped door-like means with one panel thereof being substantially coplanar with the aligned side wall of the base, and the other legs respectively of the L-shaped members extending in confronting relation to define an end wall of the cabinet.

Hinge 16 supports the main component 10 for articulated movement from its FIG. 1 position to that position shown in FIG. 2 wherein the main component 10 is supported by the base and it in turn supports its associated drop leaf 6 in its functioning position so that it lies coplanar with the top 2, as shown in FIG. 2 of the drawing.

The main components 10, 12 are each provided with hinges which support in the angle thereof compartments or sub components 22, 24 respectively.

Figure 4:
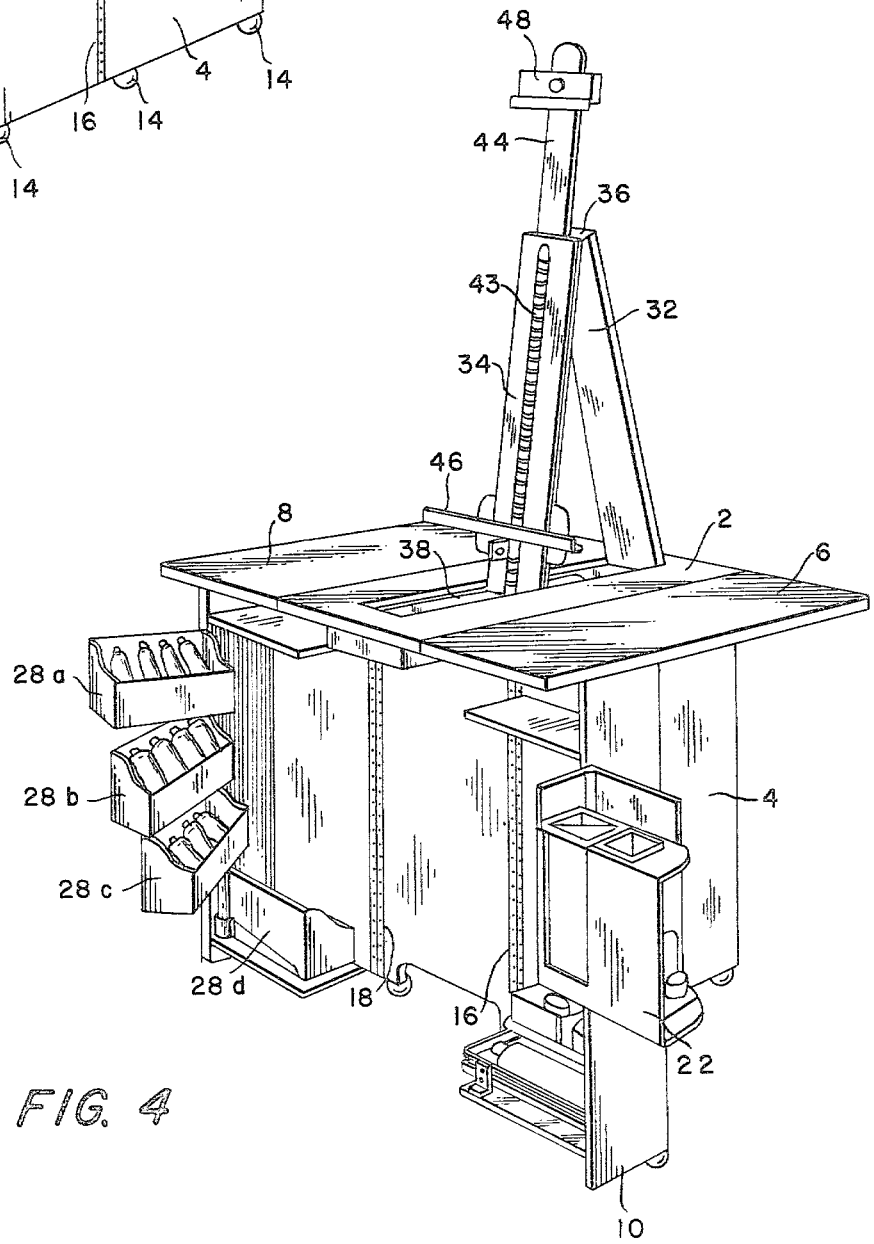
FIG. 4 is a perspective view of the convertible studio in which the sub components have been articulated to a functioning position.

Sub component 22 is attached to and supported from the main component 10 by the piano hinge 20 in such a manner that it can be articulated from a nested position where it is hidden as shown in FIG. 1 to a functioning position as shown in FIG. 4. The details of the nesting of the sub component 22 is also shown in FIG. 2. The sub component 22 when moved to its functioning position exposes trays for turpentine and oil, etc., and containers for brushes, pallette knives, etc.

Sub component 24 comprises a number of baskets 28 each carrying a bearing-type bracket 29 which is supported by the shaft 21 (FIG. 2) carried by the main component 12. With this structure, the baskets 28 are supported for articulated movement from their nested position as shown in FIG. 2 to any one of the positions in FIG. 4. The trays 28-*a,b,c,d* are used to hold artist's equipment such as paint tubes.

Figure 3:
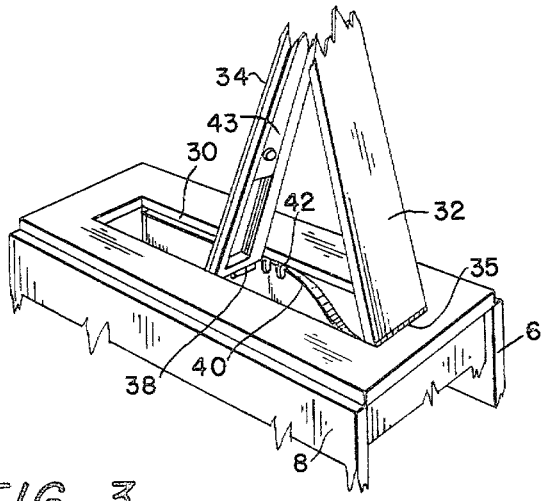
FIG. 3 is a partial perspective view of the studio easel supporting mechanism in its functioning position.

Referring now to FIG. 2 and FIG. 3 of the drawing, the table top 2 provided with a slot 30 which lies parallel to and between the first hinge means which support the drop leafs 6, 8 from the base 4. Slot 30 is proportioned to accommodate or house a first easel leg 32 and a second easel leg 34 when they are in their nested positions. Easel leg 32 is shown nested in FIG. 1 in the enclosure defined between the side walls of the cabinet.

Referring now to FIG. 2 and FIG. 3, the first easel leg 32 is attached to the top 2 by hinge 35 (4th hinge means) to accommodate the articulation of the first easel leg 32 from its nested position to its functioning position. The second easel leg 34 is attached at one end by a hinge 36 to the end of the first easel leg 32 opposite its attachment to the top 2. The second easel leg 34 is provided with a cam follower 38 in the form of a transverse pin extending beyond the side edges of leg 34 while being parallel to the 5th hinge means. The top 2 is provided with a cam 40 in the form of a groove which is hidden within the base when the components are in their nested position but which guides the movement of the second easel leg 34 and accordingly controls the movement of the first easel leg 32 when the easel legs are articulated from their nested position to their active position. The cam 40 is provided with a plurality of notches 42 which accommodate the transverse cam follower 38 thereby positioning the second easel leg 34 at a selected position.

Second leg 34 defines a central groove 43 which houses and accommodates a slide support 44 which may be extended to accommodate various sizes of canvas. A pair of easel spacers 46, 48 are provided to be attached to the second easel leg 34 and to the slide support 44, respectively, to hold a canvas in working position.

OPERATION

With this invention, the artist is now able to have a beautiful article of furniture in his livingroom which when all the components are in their nested position has the appearance of a uni-leg supported drop leaf table. When the components are articulated to their functioning position, the drop leafs are supported to be co-planar with the top by the main components. Then when the sub components are articulated to their functioning position, the artist has accessible the tools of his trade. The studio is complete when the first and second easel legs are articulated to their functioning position as shown in FIG. 4 to support a canvas.

It is obvious that the present embodiment of the invention is to be considered as only illustrative and not restricted since the invention may be embodied in other specific forms without departing from the spirit or essential characteristics.

Accordingly, what is claimed and desired to be secured by United States Letters Patent, is:

1. A convertible cabinet-like article of furniture for artists's use and the like comprising:

a base including spaced opposed side walls defining an enclosure therewithin, a pair of complementary L-shaped door-like cabinet portions respectively vertically hingedly connected to one side of said side walls in normally substantially coplanar relation therewith and the angled leg portions thereof extending in confronting relation to define a substantially planar end wall of the cabinet, support feet for said cabinet side walls and for said door-like portions, said support feet permitting ready swinging outward movement of said door-like portions, said cabinet having a top planar surface, thereby defining with said side walls and said L-shaped door-like portions the overall cabinet, said L-shaped door-like portions having with the included angle thereof a plurality of storage compartment, whereby upon respective outward swinging of said L-shaped door-like portions through substantially 90°, the said respective compartments become accessible laterally on either side of the enclosure defined between said side walls, whereby said L-shaped door-like portions cooperate with said side walls to minimize overall dimensions of said cabinet in closed and open positions.

2. The cabinet of claim 1 wherein said top surface includes drop-leaf panels on either side thereof hingedly secured thereto in normally depending overlying relation to said side walls, said hinge means permitting upward swinging of said drop-leaf panels to substantially coplanar relation with said top surface and wherein further said L-shaped door-like portions in the hinged open position underlie and support said leaves as leg-like supports.

3. The cabinet of claim 1 wherein said compartments in said L-shaped door-like portions are respectively vertically hinged thereto, whereby upon hinge-opening of said L-shaped door portions, said respective compartments may be swung outwardly to provide access to the user.

4. The cabinet of claim 1, 2, or 3 wherein said enclosure between said side walls has received therewithin means defining a collapsible artist's easel, said easel including elements hingedly associated with said top surface of said cabinet to lie coplanar therewith when said easel is in stored position within said enclosure, and wherein said easel may be elevated from said compartment and disposed in exposed working relation to said top surface for access by the cabinet user.

* * * * *